US005217636A

United States Patent [19]

Paboucek

[11] Patent Number: 5,217,636

[45] Date of Patent: Jun. 8, 1993

[54] LUBRICATING OIL VISCOSITY INDEX IMPROVER COMPOSITION

[75] Inventor: James L. Paboucek, Midlothian, Va.

[73] Assignee: Albright & Wilson Americas Inc., Ashland, Va.

[21] Appl. No.: 850,458

[22] Filed: Mar. 10, 1992

[51] Int. Cl.[5] ..... C10M 157/00

[52] U.S. Cl. ..... 252/56 R; 252/568; 585/10

[58] Field of Search ..... 585/10; 252/565, 56 R

[56] References Cited

U.S. PATENT DOCUMENTS

| | | | |
|---|---|---|---|
| 4,546,137 | 10/1985 | Rossi et al. | 252/56 S |
| 4,922,046 | 5/1990 | Kinoshita et al. | 252/56 S |
| 4,933,099 | 6/1990 | VerStrate | 585/12 |
| 4,956,122 | 9/1990 | Watts et al. | 585/12 |
| 5,026,496 | 6/1991 | Takigawa et al. | 252/56 S |

FOREIGN PATENT DOCUMENTS 0281060 9/1988 European Pat. Off. .

*Primary Examiner*—Ellen McAvoy

*Attorney, Agent, or Firm*—Frishauf, Holtz, Goodman & Woodward

[57] ABSTRACT

The invention is an improvement in wide viscosity range multigrade lubricants of the type having a mineral oil base into which is added a viscosity index improver and a wear enhancer package and, more specifically, in the viscosity index improver which is used. The viscosity index improver mixture of contains (a) 85 to 99.5% by weight, preferably 91%-95% by weight, of low molecular weight ethylene-propylene copolymers; and (b) 0.5 to 15% by weight, preferably 5% to 9% by weight, of an esterified alkenyl-vinyl polymer pour point depressant to make 100% total amount of (a) and (b). Normally, this mixture will be contained in the base lubricant in an amount of about 1% to 95% by weight, preferably 1% to 25% by weight or 1 to 20% by weight and, most preferably, either 1-5% or 3-10% depending on the desired viscosity properties. To ensure the effect of the compounds in the final mixture, the pour point depressant component (b) should be present in the multigrade lubricant in an amount of at least about 0.1%, preferably 1.5%, and the ethylene-propylene copolymer component (a) should be present in an amount of at least 2% and preferably 25-35%.

27 Claims, No Drawings

LUBRICATING OIL VISCOSITY INDEX IMPROVER COMPOSITION

BACKGROUND OF THE INVENTION

The present invention relates to wide range viscosity multi-grade lubricants. This is a class of lubricants that, because of their wide viscosity range, permit use where the lubricant must maintain its effectiveness across a wide temperature range.

Lubricant viscosity is usually graded using SAE (Society of Automotive Engineers) designations. These are well defined in the industry. Depending on the final use, there are other standards which must also be met including wear properties and resistance to oxidation. Thus, for example, for a wide viscosity lubricant to be useful as a multigrade gear oil, it must not only maintain the appropriate viscosity, but must also pass a so-called MACK Standard Test 5GT73 "Transmission Test for Evaluation of Thermally Stable Gear Oil." This is, in essence, a test which requires survival of the lubricant when subjected to a predetermined number of "shifts" under predetermined conditions in a transmission for a Mack truck. The tests are available at independent laboratories and are industry standards for certain commercial purposes (especially gear box lubricants).

The uses of wide range viscosity multigrade lubricants are many. These include multigrade gear oil (SAE 80W-140) for use in gear boxes (final drives or axles of trucks or transmissions in a truck or heavy equipment) hydraulic oils, metal working fluids and possible engine oils for special purposes. In general, a wide range viscosity multigrade lubricant can allow equipment to be started under extreme low temperatures and be placed under load fairly quickly because the lubricant has low viscosity characteristics at low temperatures. Furthermore, because the lubricant has a wide range viscosity, it maintains effectiveness even at operating temperatures and under load for the equipment. Without the use of wide range multigrade viscosity lubricants, it may be necessary either to start, for example, a hydraulic pump and let it warm up several hours before it can be used under load, or to keep equipment operating at idle to avoid such a warm-up period. Otherwise, in cold weather, the lubricant will solidify or freeze and not be available to lubricate the equipment. Wide range lubricants prevent this freeze-up at low temperatures while providing adequate lubrication at higher operating temperatures.

As can readily be understood, wide viscosity lubricants can be very important under a wide range of actual operating conditions for many applications. It is known to formulate various lubricants to provide wide range viscosity characteristics in order that the temperature range of service for the lubricant can be extended. However, these formulations can be costly especially for widest range formulations to be used under extreme conditions.

It is known that the temperature range of service for gear oils and hydraulic oils can be extended by adding polymeric thickeners viscosity index improvers (VII's) and wax crystal modifiers (pour point depressants or "PPD's") to relatively nonviscous base fluids of both mineral oil and synthetic types. Common commercial polymer thickeners include low molecular weight polyalkyl methacrylates and polyisobutylenes (PIB) used in gear oils, predominately polyalkyl methacrylates with MW of 10,000–2,000,000 used in high viscosity index (VI) hydraulic oils, and a variety of thickeners including styrene isoprene block copolymers, olefin copolymers, and polyalkyl methacrylates for use in multigrade engine oil. Various PPD's are added to all these oils to improve low temperature pumpability. Alternative systems employ synthetic fluids such as polyalpha olefins (PAO's) and polyol esters to meet the industry's viscometric requirements, but at premiums in cost of 400% or more.

As discussed above, specific to gear oils is a Society of Automotive Engineers (SAE) rating system which defines the useful Operating temperature of the oil based on results obtained from specific American Society for Testing and Materials (ASTM) tests. The rating system imposes cold and hot temperature restraints. For example, a gear oil having an SAE grading of "140" must have a kinematic viscosity (as measured by ASTM D-445) of greater than 24 centistokes (cSt) at 100° C. To obtain an "80W" rating it must have a viscosity (as measured by ASTM D-2983) of less than 150,000 centipoise (cP) at −26 C. A fluid which meets both constraints concurrently obtains a viscometric rating of 80W-140. Similarly, a fluid with a greater than 13.5 cSt kinematic viscosity at 100° C. and a viscosity of less than 150,000 cP. at −40° C. is rated a 75W-90 grade. This art has found that mineral oils alone or in combination with pour point depressants will not meet these requirements. Viscosity index improvers have been used in combination with pour point depressants to meet these requirements, but are inadequate for various reasons. Thus, although mineral oils have a cost advantage over synthetic-based lubricants, their useful temperature range is limited and until now could not be improved at low cost while maintaining a high quality lubricant.

To date, three major commercial multigrade gear oil systems are available.

(1) Very light (4–6 cSt at 100° C.) mineral oils which have been treated with pour point depressants (PPD) to reach the 80W requirements. These oils are then thickened with large amounts (30% or more) of polyisobutylenes viscosity index improvers (PIB VII) to a 140 grade. The result is an 80W-140 gear oil.

However, gear oils using PIB viscosity index improvers have poor cold temperature performance as their primary disadvantage. PIB's barely meet the 80W viscometric requirements and are successful only when treating very light oils with large amounts of polymer and adding 2% or more supplemental pour point depressants and/or by adding an expensive "spike" of synthetic fluid of 5% or more. SAE 75W-90 grade oils cannot be produced with commercial PIB's and mineral oil because the cold temperature targets cannot be met.

(2) Mineral Oil Blends in the 6–12 cSt range at 100° C. range thickened with polyalkyl methacrylates (PMA's) to a 140 grade, and 3–5 Cst at 100° C. mineral oil blends thickened to a 90 grade. These blends solve the cold temperature problems but at the expense of often increased oxidation. Additionally, commercial PMA's used are in the 20,000–50,000 MW range and thus suffer from large viscosity losses of up to 50% in field performance. These loses push the fluid out of grade on the hot side, and result in lowered film strength and thus less wear protection. One alternative solution is to use low molecular weight PMA's with peak MW's below 10,000 which will shear less. These low MW PMA's are much less efficient thickeners requiring treat rates which are nearly doubled and making costs commercially unacceptable.

(3) Fully synthetic fluids such as blends of polyalkyl olefin (PAO's) and/or polyol esters. These blends provide the widest temperature range of operation and good oxidation performance. Their primary disadvantage is in their high cost of 3–5 times more than viscosity index improved mineral oils. Also some seal and additive compatibility problems can occur with these fluids.

In summary, the known use of these high molecular weight VI improvers, in the production of multigraded lubricants have some serious drawbacks:

a. They are susceptible to large permanent viscosity losses from mechanical shearing when exposed to the high shear rates and stresses encountered in gear boxes.

b. They struggle to meet or do not meet the cold temperature viscosity requirements.

c. They are often too costly to be employed.

d. They can be susceptible to oxidation, creating organic acids which can cause corrosion, wear, and/or formation of unwanted deposits.

e. They are susceptible to a high degree of temporary shear.

(Temporary shear viscosity loss is the result of the non-Newtonian viscometrics associated with solutions of high molecular weight polymers. It is caused by an alignment of the polymer chains with the shear field under high shear rates with a resultant decrease in viscosity. The decreased viscosity reduces the wear protection associated with viscous oils. Newtonian fluids maintains their viscosity regardless of shear rate.)

The use of low MW PMA's with light mineral oils has the disadvantage of requiring large treat rates to attain required results, so that costs are high. Similarly, costs are high with fully synthetic blends.

One solution to the problem of providing multiviscosity lubricants is described by Watts et al in U.S. Pat. No. 4,956,122 wherein certain combinations of fluids and additives are used to prepare multigraded lubricants which outperform prior art formulations and have none or a greatly decreased amount of the above listed deficiencies found in polymerically thickened oils. However, these fluids require expensive synthetic oil components. (See discussion (3) above.)

The present invention has an object is to provide a polymer system that can be added to mineral oil blends to produce wide range viscosity 80W-140 and SAE 75W-90 lubricants. This allows the use of relatively low cost mineral oils or "bright stock" in place of expensive polymers.

A further object is to provide wide range viscosity lubrication that also provides (1) the cold temperature performance of PMA's, (2) the oxidation and shear stability of PIB's, and (3) the low cost of VI improved mineral oils that meet industry requirements without expensive synthetics.

SUMMARY OF THE INVENTION

More specifically, the present invention accomplishes the objects by providing wide range multigrade gear oil using relatively inexpensive high viscosity synthetic hydrocarbons, low viscosity mineral oils or synthetic hydrocarbons and optionally low viscosity esters. The finished oils thus prepared exhibit very high stability to permanent shear and, little, if any, temporary shear and so maintain the viscosity required for proper wear protection. The oils of this invention have better stability toward oxidative degradation than those of the prior art. The unexpectedly strong thickening power produced from the present invention permits the preparation of broadly multigraded gear oils such as 75W-90 and 80W-140 grades. Up to now it has been difficult if not impossible, to prepare such lubricants without the use of frequently harmful amounts of polymeric VI improvers or expensive synthetics.

More specifically, the objects of the invention are accomplished by blending (a) 85–99.5% by weight of very low molecular weight ethylene-propylene copolymer (as a viscosity index improver) with (b) 0.5–15% of an esterified alkenyl vinyl polymer as a pour point depressant (to make 100% by weight total of (a) and (b), normally in 100 solvent neutral paraffinic oil as a diluent to produce a new class of lubricant viscosity index improver for use with heavy mineral oil (25–50 cSt at 100° C. paraffinic oil) such as "bright stock." When used in a wide viscosity range lubricant mixture with a mineral oil base, the ethylene-propylene copolymer should be present in the final mixture in an amount of at least 2% by weight, and the esterified alkenyl-vinyl polymer pour point depressant should be present in an amount of at least 0.1% by weight, to ensure that the desired effect is obtained.

Ethylene-propylene copolymers are viscosity index improver (VII's) with thickening efficiency superior to other polymers of similar molecular weight (MW) of the type described previously. Although ethylene-propylene copolymers have been used commercially in engine oils, this has only been in the form of high MW types (shear unstable) of typically 1 million molecular weight or more. Low MW ethylene-propylene copolymers are generally those with molecular weights of 2,000–80,000 and more usually 6,000 to 12,000. Most preferably, ethylene-propylene copolymers with molecular weights in the range of 8,500–2,000 provide sufficient thickening at high temperatures with economical treat rates. We have found approximately 9,200 MW to work well, and it is available commercially. There has been no commercial use of these low MW ethylene-propylene copolymers in lubricating oil as their cold temperature performance is inadequate. Such polymers are commercially produced and used primarily in formulations for sealants and caulking compounds. The present invention is based in part on the discovery of their usefulness as a lube oil additive in mineral oil systems.

The invention is further based on the discovery that the addition of a pour point depressant such as PMA pour point depressants but especially esterified alkenyl-vinyl polymer type pour point depressants to this previously unused low MW ethylene-propylene copolymer (diluted in highly refined solvent neutral oil) produces a viscosity index (VI) improver polymer system which yields multigrade gear oils which convincingly meet SAE cold temperature requirements without the use of synthetics while providing improved oxidation and shear stability. Base oil viscosity before VI improver addition can be doubled at least as compared with PIB based formulations, thus polymer treat rate is approximately 50% less. At this low treat rate equivalent to commercial PMA based formulations, shear stability is improved more than 50%.

DETAILED DESCRIPTION

The molecular weights defined in this application are approximate and generally are obtained by a comparison method. The procedure for determining molecular weight (which is often used in this industry) is based on the determination of the molecular weight of a number of "standard" polymers and then estimating the molecular weight by a viscosity effect comparison. More specifically, the molecular weight measurement is made by comparing the relative thickening power of the unknown polymer to a linear plot of the thickening power of polymers of known molecular weights (via vapor phase osmometry). For example, if 5% of the polymer added to a standard 4 cSt PAO fluid yields a Kinematic viscosity of 8 cSt, and it is known that a 4,000 MW polymer yields 9 cSt, then the unknown polymer is quoted to be 3,200 MW.

The invention is an improvement in wide viscosity range multigrade lubricants of the type having a mineral oil base into which is added a viscosity index improver and a wear enhancer package and, more specifically, in the viscosity index improver which is used. The viscosity index improver mixture of contains (a) 85 to 99.5% by weight, preferably 91%-95% by weight, of low molecular weight ethylene-propylene copolymers; and (b) 0.5 to 15% by weight, preferably 5% to 9% by weight, of an esterified alkenyl-vinyl polymer pour point depressant to make 100% total amount of (a) and (b). Normally, this mixture will be diluted in a solvent oil to be added to a base oil or lubricant in an amount such that the mixture of (a) and (b) will be contained in the base oil or lubricant in an amount of about 1% to 95% by weight, preferably 1% to 25% by weight or 1 to 20% by weight and, most preferably, either 1-5% or 3-10% depending on the desired viscosity properties. To ensure the effect of the compounds with the final mixture, the pour point depressant component (b) should be present in the multigrade lubricant in an amount of at least about 0.1%, preferably 1.5%, and the ethylene-propylene copolymer component (a) should be present in an amount of at least 2% and preferably 25-35%.

The preferred ethylene-propylene copolymer used in this invention is a fully saturated one with a viscosity average MW in the range of about 2,000 to 80,000. Higher molecular weight copolymers would be insufficient in shear stability to be generally useful. Most usually, copolymers in the 6,000 to 12,000 MW range will be used with 8,500-12,000 MW being preferable. Most preferable are commercially available copolymers having a molecular weight of about 9,200.

A product called "TRILENE CP-80" available from Uniroyal Chemical Company, Inc. has been found to give good results and is commercially available at reasonable costs. This copolymer is produced in a viscosity average molecular weight range having an upper limit of 9,000-9,200 and a general formula $(CH(CH_3)—CH_2-)_m—(CH_2—CH_2)_n—$. The ratio of n to m is, on the average, 43 to 57. The present invention preferably uses the range of 9,000-9,200 to optimize thickening power while maintaining good shear stability. Uniroyal also produces a series of copolymers of ethylene and propylene containing a third monomer which includes a bridged six-membered ring (fully saturated) and a second partially unsaturated group. These bear tradenames of "TRILENE" and designation 55, 65, 66, 67 and 68, and have viscosity average molecular weights in the range of 5,200 to 8,000. Although these work from a viscosity improver point of view, they are less efficient and, because of their approximately 3-100% unsaturation, they are less oxidation stable and may cause difficulty in meeting oxidation resistance requirements of the MACK Transmission Test.

As the second component, a commercially available pour point depressant is used. An esterified alkenyl vinyl polymer called "Nalco 5663" has been found suitable and is commercially available from Nalco Chemical Company. Other pour point depressants including some polyalkyl methacrylate types have also been used. Some are not quite as efficient.

Nalco 5663 is a mixture of about 36% polyalkyl acrylate in a light oil carrier.

The acrylate polymer has a formula:

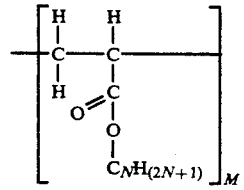

where N=9 through 18 as delineated in the analysis. The molecular weight (which would depend on M) is typically 300,000-500,000. The polymer was hydrolyzed, and gas chromatographic analysis showed the following alcohol distribution:

| Alcohol | Weight % |
|---|---|
| C-9 | 2.0 |
| C-10 | 5.0 |
| C-11 | 4.8 |
| C-12 | 31.2 |
| C-14 | 15.0 |
| C-16 | 15.3 |
| C-18 | 26.8 |

However, excellent results would be expected for products containing 35-40% of an acrylate polymer (in a suitable carrier for ease in handling; such as 60-200 paraffinic mineral oil) and having a general structure.

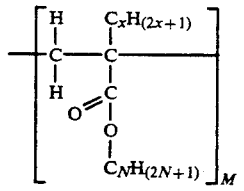

where x=0, 1 or 2; N=6 through 20, and M=500-5,000.

For convenience of handling as well as rapid mixing into the base mineral oil, a refined low viscosity mineral oil is preferably used as a diluent for compounding the mixture. The neutral paraffinic 100 oil is most preferred as a diluent. However, any well refined oil of this viscosity grade can be used. Both "Exxon 100 low pour" (trade name) and "Sunpar 110" (trade name) oils ("neutral 100 oil") have been used with good results. Furthermore, depending on the circumstances, any 60-200 paraffinic neutral oil is usable, and the base oil can be used.

The viscosity index improver of the present invention may be used to formulate multigrade gear oils from a wide variety of mineral oils from major refiners. The viscosity index improver of the present invention is especially efficient in combinations of refined oils such as "150 Brightstock" mixed with 100 or 200 solvent neutral oils to produce a very wide range viscosity 80W-140 grade lubricant.

In the preferred embodiments, the active components are low molecular weight ethylene-propylene and polyalkylacrylate. The ethylene-propylene copolymers (OCP) for use in this invention are blended in an amount relative to the total amount of OCP and alkenyl-vinyl polymers, of about 60% to 99.5% by weight, with the rest being alkenyl-vinyl polymers diluted about 36% in a light mineral oil (e.g., "NALCO 5663"). This mixture is normally prepared in a solvent such as the pour point neutral 100 oil mentioned above, or any other light weight oil that can be blended into the mineral oil to be treated without adverse effect. About a 2 and 3 times dilution factor produces a commercially desirable product with good handling properties.

Depending on the desired viscosity, a 1-3 time dilution can be used. Usually, a 2-3 time diluted mixture (in 100 neutral oil) can be added to a base oil in an amount of 5-95% and usually in amounts less than 50% except in extreme cold uses. Above about 65%, cost factors make formulation non-competitive with other products. Typically, prior art polymer mixtures require 40% while good results are available with the present invention at 10-20% of the diluted mixture (3-10% of the mixture of active components). Thus, the present invention will usually be added in an amount no more than about 65%. About 15% will usually give SAE 80W-140 lubricant and about 10% is sufficient for SAE 75W-90 lubricants. Because the present invention has a practical object to reduce costs of making a wide viscosity lubricant by maximizing the use of (relatively) low cost mineral oil rather than synthetics, it is preferable to use formulations as high as possible in mineral oil as will pass required industry viscosity and wear tests.

EXAMPLES

Preparation of viscosity index improver: low molecular weight viscosity index improver-1 (VI-1).

A mixture of (a) 28% ethylene-propylene copolymers ("TRILENE CP-80" from Uniroyal Chemical Company);

(b) 5% of a 36% mixture esterified alkenyl vinyl polymer in a light oil carrier ("Nalco 5663" from Nalco Chemical Company);

(c) 6% of a wear improver package containing 1-39% phosphorus and 20-30% sulfur, which is the standard in the industry; and the rest to make 100% by weight of a solvent neutral oil was prepared as a viscosity index improver. This package is added to the final gear oil but not the "VI improver."

EXAMPLE 1

10% of VI-1 is added to a mixture of 10% Brightstock and 90% 65 neutral oil. The resulting lubricant contains approximately 2.8% OCP and 0.2% of the alkenyl-vinyl polymers and has a SAE viscosity grade rating of 75W-90.

EXAMPLE 2

15% of VI-1 is added to a mixture of 50% weight Brightstock and 50% -100% neutral oil. The resulting lubricant contains approximately 4.2% OCP and 0.4% of the alkenyl-vinyl polymers and has a SAE viscosity grade rating of 80W-140.

It is usual to add a wear improver or wear package to lubricants to improve wear properties. These packages contain dispersants and antioxidants. They are generally high sulfur, high phosphorous ("hi sulphur phos") containing compositions. In the United States, there are two such packages in general use: "HITEC 375" from ETHYL PETROLEUM ADDITIVES and "6043" from LUBRIZOL. The actual amounts of these materials used are based on the distributor recommendation. Lower viscosity lubricants use more (8-9% is usual) to improve wear, while higher viscosity lubricants use lesser amounts (6-7%) to provide needed properties at minimum costs.

The present invention does not adversely effect the properties of these additives and can be used with them. Thus, the present invention can be used with usual products of the industry and provides a useful advance in this art.

Although the invention has been described in considerable detail with particular reference to certain preferred embodiments thereof, variations and modifications can be effected within the spirit and scope of the invention. In particular, it is noted that in this field considerable variation would be obvious especially with respect to carrier solvents or oils and the amounts of the components to be used, depending on the desired object. The present invention was made with the object to provide high quality multi-viscosity lubricants at economical costs using mineral base oils.

What is claimed is:

1. In a wide range viscosity multigrade lubricant of the type having a mineral oil base into which is added a viscosity index improver and a wear enhancer package, the improvement wherein the viscosity index improver comprises a viscosity index improver mixture of (a) 85 to 99.5% by weight low molecular weight ethylene-propylene copolymers having a viscosity average molecular weight of 8,500 to 12,000; and (b) 0.5 to 15% of an esterified alkenyl-vinyl polymer pour point depressant to make 100% total amount of (a) and (b);

said mixture being contained in the base lubricant in an amount of about 1% to 95% by weight, with the proviso that component (b) is present in the multigrade lubricant in an amount of at least about 0.1% and component (a) is present in an amount of at least 2%.

2. The wide range viscosity lubricant of claim 1 wherein the ethylene-propylene copolymers are present in the viscosity index improver mixture in an amount, relative to the total amount of (a) and (b), of 91% to 95% of (a) the ethylene-propylene copolymer, and 5% to 9% of (b) the esterified alkenyl-vinyl polymers to make 100% total.

3. The wide range viscosity index lubricant of claim 2 wherein the viscosity index improver mixture is present in the lubricant in an amount of 3-10%.

4. The wide range viscosity lubricant of claim 1 wherein the ethylene-propylene copolymers are present in the multigrade lubricant in an amount of about 25-35% and the esterified alkenyl-vinyl polymers are present in an amount of about 1 to 5%.

5. The wide range viscosity lubricant of claim 1 wherein the viscosity index improver mixture is present in an amount of 1% to about 20%.

6. The wide range viscosity lubricant of claim 1 wherein the viscosity index improver mixture is present in an amount of 1% to about 5%.

7. The wide range viscosity index lubricant of claim 1 wherein the viscosity index improver mixture is present in an amount of 3–10%.

8. The wide range viscosity lubricant of claim 1 wherein the ethylene-propylene copolymer is present in an amount of approximately 2.5–3% by weight and the alkenyl-vinyl polymer pour point depressant is present in an amount of approximately 0.2% in the multigrade lubricant.

9. The wide range viscosity lubricant of claim 1 wherein the ethylene-propylene copolymer is present in an amount of approximately 4–4.5% by weight and the alkenyl-vinyl polymer pour point depressant is present in an amount of about 0.4% by weight in the multigrade lubricant.

10. The wide range viscosity lubricant of claim 1,3,12 or 9 wherein the viscosity average molecular weight is about 9,000–9,200.

11. The wide range viscosity index lubricant of claim 2 wherein the viscosity index improver mixture is present in the lubricant in an amount of 3–10%.

12. In a wide range viscosity multigrade lubricant of the type having a mineral oil base into which is added a viscosity index improver and a wear enhancer package, the improvement wherein the viscosity index improver comprises a viscosity index improver mixture of (a) 85 to 99.5% by weight low molecular weight ethylene-propylene copolymers; and (b) 0.5 to 15% of an esterified alkenyl-vinyl polymer pour point depressant to make 100% total amount of (a) and (b);

said mixture being contained in the base lubricant in an amount of 1 to about 25% by weight with the proviso that component (b) is present in the multigrade lubricant in an amount of at least about 0.1% and component (a) is present in an amount of at least 2%.

13. The wide range viscosity lubricant of claim 12 wherein the ethylene-propylene copolymers are present in the viscosity index improver mixture in an amount, relative to the total amount of (a) and (b), of 91% to 95% of (a) the ethylene-propylene copolymer, and 5% to 9% of (b) the esterified alkenyl-vinyl polymers to make 100% total.

14. The wide range viscosity lubricant of claim 12 wherein the viscosity index improver mixture is present in an amount of 1% to about 20%.

15. The wide range viscosity lubricant of claim 12 wherein the viscosity index improver mixture is present in an amount of 1% to about 5%.

16. The wide range viscosity index lubricant of claim 12 wherein the viscosity index improver mixture is present in an amount of 3–10%.

17. The wide range viscosity lubricant of claim 12 wherein the ethylene-propylene copolymer is present in an amount of approximately 2.5–3% by weight and the alkenylvinyl polymer pour point depressant is present in an amount of approximately 0.2% in the multigrade lubricant.

18. The wide range viscosity lubricant of claim 12 wherein the ethylene-propylene copolymer is present in an amount of approximately 4–4.5% by weight and the alkenylvinyl polymer pour point depressant is present in an amount of about 0.4% by weight in the multigrade lubricant.

19. The wide range viscosity lubricant of claim 12, 11 or 18 wherein the low molecular weight copolymer has a molecular weight of about 8,500–12,000.

20. The wide range viscosity lubricant of claim 12, 11 or 18 wherein the molecular weight is about 2,000–12,000.

21. The wide range viscosity lubricant of claim 12 wherein the molecular weight is about 9,000–9,200.

22. A viscosity index improver for lubricants comprising an active component mixture of (a) and (b) containing (a) 85% to 99.5% by weight low molecular weight ethylene-propylene copolymers; and (b) 0.5 to 15% esterified alkenyl-vinyl polymers to make 100% total amount of (a) and (b);

said active component being diluted 1–3 times in a carrier oil solvent.

23. The viscosity index improver of claim 22 wherein the active component mixture contains 91% to 95% of (a) the ethylene-propylene copolymer, and 5% to 9% of (b) the esterified alkenyl-vinyl polymers to make 100% total.

24. The viscosity index improver of claim 22 wherein the active component mixture is diluted 2–3 times in 60–200 neutral oil as the carrier oil solvent.

25. The viscosity index improver of claim 22 wherein the viscosity average molecular weight of the low molecular weight copolymers is in the range of 8,500–12,000.

26. The viscosity index improver of claim 25 wherein the viscosity average molecular weight of the low molecular weight copolymers is in the range of 9,000–9,200.

27. A viscosity index improver consisting essentially of a mixture of (a) approximately 28% ethylene-propylene copolymers having a viscosity average molecular weight in the range of 9,000–9,200;

(b) approximately 5% of a 36% mixture esterified alkenyl vinyl polymer;

(c) approximately 6% of a wear improver package containing 1–39% phosphorus and 20–30% sulfur; and to make 100% by weight, a solvent neutral oil.

* * * * *

UNITED STATES PATENT AND TRADEMARK OFFICE

CERTIFICATE OF CORRECTION

PATENT NO. : 5,217,636

DATED : June 8, 1993

INVENTOR(S) : James L. PABOUCEK

It is certified that error appears in the above-identified patent and that said Letters Patent is hereby corrected as shown below:

Column 9, line 16 (Claim 10), delete ", 12".

Signed and Sealed this

Thirtieth Day of August, 1994

*Attest:*

*Attesting Officer*

Bruce Lehman

BRUCE LEHMAN

*Commissioner of Patents and Trademarks*